US005397219A

United States Patent [19]

Cretors

[11] Patent Number: 5,397,219

[45] Date of Patent: Mar. 14, 1995

[54] INTEGRAL LIQUID PUMP AND DRAINBACK VALVE

[75] Inventor: Charles D. Cretors, Lake Forest, Ill.

[73] Assignee: C. Cretors & Company, Chicago, Ill.

[21] Appl. No.: 80,902

[22] Filed: Jun. 21, 1993

[51] Int. Cl.[6] ..... F04B 49/00

[52] U.S. Cl. ..... 417/299; 417/310; 137/107

[58] Field of Search ..... 417/299, 310, 434; 137/107, 102

[56] References Cited

U.S. PATENT DOCUMENTS

| | | | |
|---|---|---|---|
| 188,905 | 3/1877 | Hildebrand . | |
| 513,635 | 1/1894 | Deverall . | |
| 1,045,964 | 12/1912 | Friese . | |
| 2,733,841 | 2/1956 | Waas . | |
| 3,097,610 | 7/1963 | Swanson | 417/310 |
| 3,606,905 | 9/1971 | Fehler | 137/107 |
| 3,628,893 | 12/1971 | Carpigiani | 417/310 |
| 3,724,723 | 4/1973 | Slavinski | 222/110 |
| 3,739,953 | 6/1973 | Cretors | 222/318 |
| 4,838,767 | 6/1989 | Ohe et al. | 417/299 |
| 4,902,202 | 2/1990 | Bowden | 417/310 |
| 5,180,291 | 1/1993 | Kent | 417/299 |

FOREIGN PATENT DOCUMENTS

| | | | |
|---|---|---|---|
| 2938663 | 4/1981 | Germany | 417/310 |
| 0688223 | 3/1953 | United Kingdom | 417/299 |

*Primary Examiner*—Richard A. Bertsch
*Assistant Examiner*—M. Kocharov
*Attorney, Agent, or Firm*—Keck, Mahin & Cate

[57] ABSTRACT

An integral liquid pump and drainback valve for use in pumping popcorn popping oil. A two-part housing is formed with one part having cavities forming inlet and outlet passages extending from an impeller cavity. A second part is formed with inlet and outlet ports and shuttle valve cavity connecting those ports. The inlet and outlet passages and the inlet and outlet ports respectively are in fluid communication with each other when the two parts are secured to each other. A resilient biasing means in the shuttle valve cavity moves the shuttle to a position wherein a fluid path is provided between the inlet and outlet ports when the pump impeller is not driven.

22 Claims, 2 Drawing Sheets

INTEGRAL LIQUID PUMP AND DRAINBACK VALVE

BACKGROUND OF THE INVENTION

This invention relates to an integral liquid pump and drainback valve intended for use in pumping popcorn popping oil from a storage container to a popcorn popping kettle. In the production of large quantities of popped popcorn, popcorn popping oil is a critical ingredient which must be delivered in a predetermined quantity, along with the corn to be popped, to the popping kettle at the beginning of a popping cycle.

This need has been met in the past by dispensing popcorn popping oil from a steel pail. A pump for pumping the oil to the popping kettle is placed in the pail through the open top of the pail. In the mass production of large quantities of popcorn, a series of independent poppers may be operated simultaneously with the popcorn popping oil being delivered by the pump to each of the plurality of poppers as they begin their respective cycles. In such a popping operation, a large quantity of popping oil must be readily available.

To better meet these needs, an improved storage and metering apparatus for popcorn popping oil has recently been invented by the applicant for this patent. The improved storage and dispensing means includes a housing having inclined shelves upon which are placed rectangular boxes containing plastic bags filled with popcorn popping oil. The shelves support the boxes in a tilted position such that a dispensing connection provided at the bottom of the plastic bag, which may be extended through the box, is in a lowermost position such that all of the popcorn popping oil may be drained through the dispensing connection from the bag. The shelves are provided with thermostatically controlled electrical heaters so as to maintain the popcorn popping oil at a desired viscosity. A pump is provided for withdrawing the popcorn popping oil from the bags and supply it to a popping kettle located at a higher elevation than the bags. This improved storage and metering apparatus for popcorn popping oil is set forth in U.S. patent application Ser. No. 07/984,063, filed Nov. 30, 1992 by the applicant and is assigned to C. Cretors & Company. The disclosure of the cited application, which issued on Apr. 12, 1994 as U.S. Pat. No. 5,301,601, is incorporated herein by reference.

As set forth in the cited patent application, the popcorn popping oil storage containers are mounted below the elevation at which the popcorn popping oil is supplied to the popping kettle. An elongated pipe or tubing is provided to deliver the popcorn popping oil from the pump discharge outlet to the popping kettle. Since popcorn popping oil may solidify at room temperatures, it is desirable that the popcorn popping oil not remain in the entire length of the pipe or tubing such that, upon cooling to room temperature, it would prevent or make much more difficult further pumping of the popcorn oil. To eliminate this problem, as disclosed in the above-mentioned patent application, a bypass path is provided between the inlet and discharge ports of the pump to permit the popcorn popping oil to drain back through the discharge pipe or tubing from the popcorn popping kettle to the supply container. When the pump is de-energized, a solenoid valve in the bypass path is energized and thereby opened to permit flow through the bypass path. Since the popcorn popping oil will flow back into the supply container until the level of the popcorn popping oil in the discharge line is equal to-the level of the oil in the container, considerably less popcorn popping oil remains in the discharge tubing or pipe to harden, or at least become more viscous.

The provision of the drainback path as disclosed in the cited patent application require installation of not only the solenoid valve, but also a bypass fluid flow path in which to connect the solenoid valve. Electronic circuitry to control the energization of the solenoid valve is also required. Further, the bypass path itself provides a further flow path in which the popcorn popping oil may solidify if not heated. Thus, it would be desirable to provide a drainback arrangement without the requirement of providing piping or tubing for a separate path, and an electrically operated solenoid valve and related electronic control circuitry.

SUMMARY OF THE INVENTION

It is an object of this invention to provide an integral liquid pump and drainback valve bypassing the pump such that a separate drainback path including a solenoid operated valve is not required. It is a further object of this invention to provide an integral liquid pump and drainback valve which is of simple construction and of reduced cost. It is still another object of this invention to provide an integral liquid pump and drainback valve which is readily assembled from a minimal number of parts. Another object of this invention is to provide an integral liquid pump and drainback valve the components of which may be readily made from materials suitable for food handling purposes and which may be readily assembled and disassembled for cleaning purposes.

In accordance with this invention, an integral liquid pump and drainback valve is formed with a two-part housing. A pump impeller cavity is formed in a first of the parts for receiving the pump impeller, which in a preferred embodiment is a pair of gears of a positive displacement gear pump. Also formed in the same housing part are outlet and inlet passages in fluid communications with the pump impeller cavity. The second housing part contains an inlet port in fluid communications with the inlet passage and an outlet port in fluid communications with the outlet passage for connection to a fluid supply line and a fluid discharge line respectively. Also formed in the second housing part is a shuttle valve cavity which is in fluid communications with both the inlet port and the outlet port. A resiliently biased shuttle is located in the shuttle valve cavity.

When the pump impeller is not being driven, the shuttle is moved by the resilient biasing means to a position in which the inlet and outlet ports are in fluid communications through the shuttle valve cavity. When the pump impeller is driven, such that fluid is pumped from the inlet passage to the outlet passage, the pressure of the driven fluid in the outlet passage is applied to the shuttle which is moved against the resilient biasing force to open a path through the outlet passage and the outlet port.

In a preferred embodiment of this invention, the two-part housing as well as the pump impeller, shuttle and resilient biasing means are formed of a material acceptable for handling foods such as aluminum or stainless steel. A circular groove formed in one of the housing members surrounds the pump impeller cavity and inlet and outlet passages such that when the housing parts are secured to each other, an O-ring placed in the groove forms a liquid tight seal between the housing parts.

DESCRIPTION OF THE PREFERRED EMBODIMENT

Figure 1:
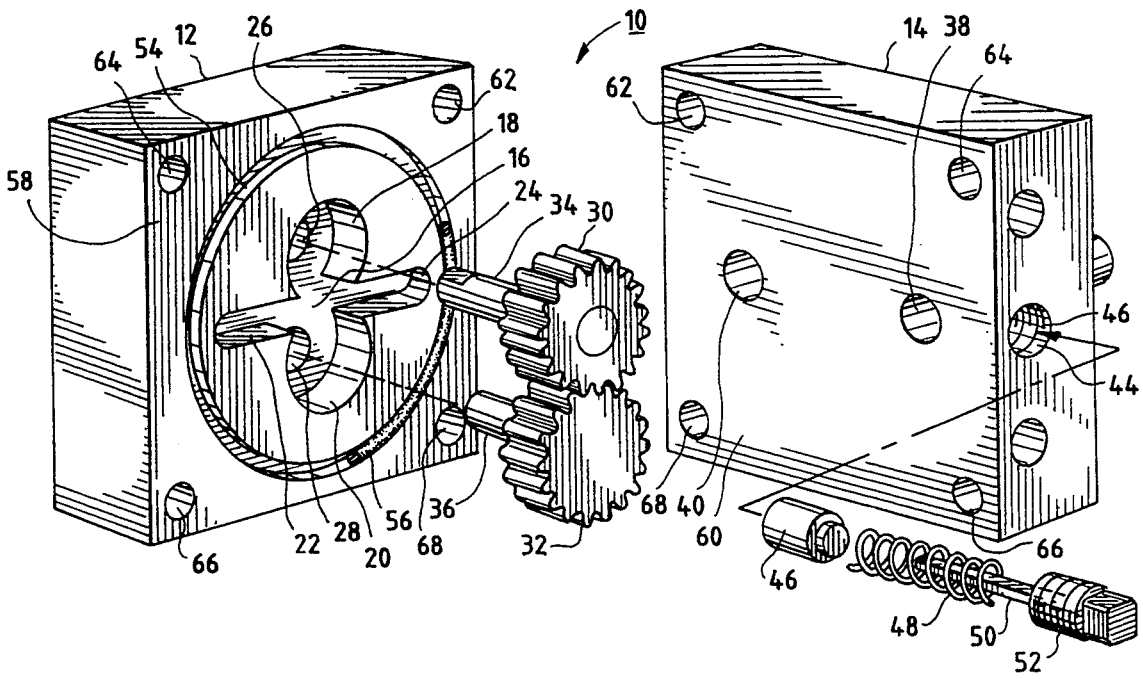
FIG. 1 is an exploded perspective view of an integral liquid pump and drainback valve in accordance with this invention.

Referring to the drawings, and particularly to FIGS. 1, 2, 4 and 5, a preferred embodiment of the integral liquid pump and drainback valve of this invention will be described. The integral liquid pump and drainback valve 10 is formed from two housing members 12 and 14. The housing members 12 and 14 are generally of a rectangular shape and in a preferred embodiment are formed by machining aluminum blocks, each of which is provided with a planar facing side. The planar facing sides mate which each other when the housing is assembled. The first housing member 12 has formed in its planar facing side a pump impeller cavity 16 in the form of partially overlapping cylindrical cavities 18 and 20. Opening into the pump impeller cavity 16 is an inlet passage cavity 22 and an outlet passage cavity 24. In alignment with the cylindrical cavity 18 is a cylindrical bore 26 which extends through the housing member from the facing side to the opposite side. A cylindrical bore 28 is provided in alignment with the cylindrical cavity 20, but it does not extend through to the opposite side of the housing.

An impeller formed of gears 30 and 32 is received within the pump impeller cavity 16. The gear 30 is provided with a shaft 34 which extends through the cylindrical bore 26 and projects from the opposite side of the housing. The gear 32 is provided with a shaft 36 which is received within the cylindrical bore 28, but which does not extend through the opposite side of the housing.

The second housing member 14 is provided with a pair of cylindrical bores 38 and 40 which extend through the housing member from the facing side to the opposite side. The bore 38 is placed such that when the housing members are secured to each other, it will be in alignment with the inlet passage 22 formed in the first housing member so as to form an inlet port. Similarly, the bore 40 is positioned such that a portion of it is in alignment with the outlet passage 22 so as to form an outlet port.

A third cylindrical bore 42 is formed in the second housing member 14 perpendicular to and intersecting the parallel bores 38 and 40 so as to form a shuttle valve cavity. One end of the shuttle valve cavity 42 terminates in the outlet port 40, and the other end opens to a side of the housing where it is provided with internal threads 44. A cylindrical shuttle 46 is received within the shuttle valve cavity 42 and is biased toward the outlet port 40 by a coil spring 48. The coil spring 48 is received around a pin 50 which extends from an externally threaded plug 52 and the end of which provides a stop for movement of the shuttle 46. The threaded plug 52 is engaged with the threads 44 in the shuttle valve cavity 42.

A circular groove 54 is formed in the facing side of first housing member 12 so as to encircle the pump impeller cavity 16 and the inlet and outlet passages 22 and 24. A resilient O-ring 56 is received within the circular groove 54. When the two housing members 12 and 14 are secured to each other with their planar facing sides 58 and 60 engaging each other, the O-ring 56 forms a seal therebetween. The housing members 12 and 14 are secured to each other by fastening means received in the holes 62, 64, 66 and 68 formed in the four corners of the two housing members.

Figure 2:
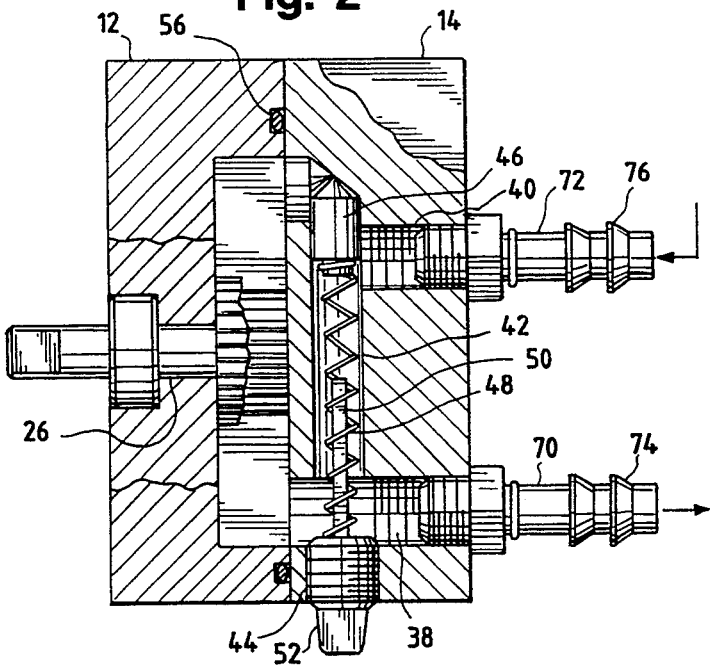
FIG. 2 is a partially sectioned plan view of the integral liquid pump and drainback valve of this invention.
Figure 4:
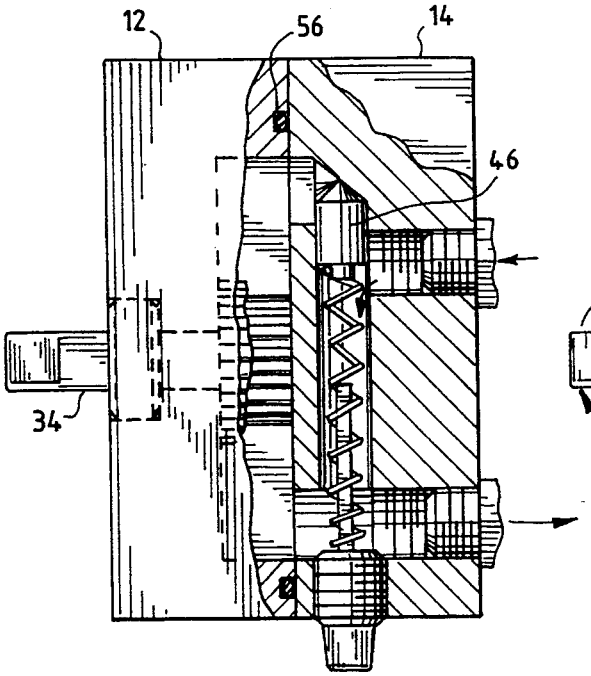
FIG. 4 is a partially sectioned plan view of the integral liquid pump and drainback valve of this invention showing the shuttle position when the pump impeller is not being driven.
Figure 5:
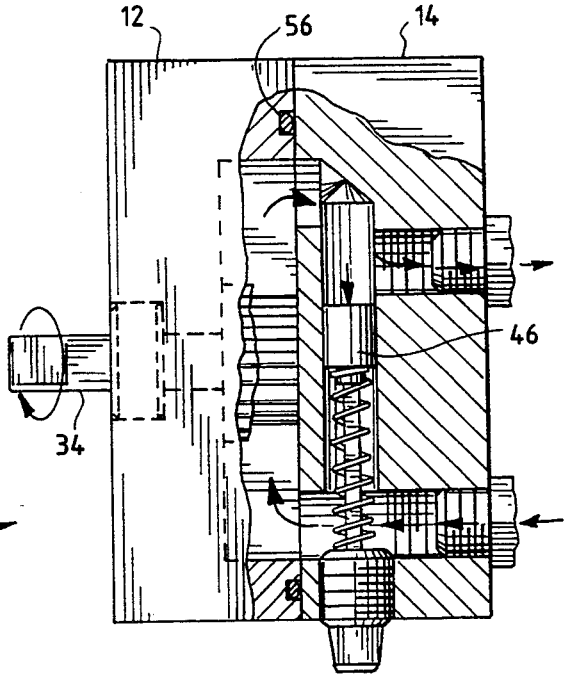
FIG. 5 is a partially sectioned plan view of the integral liquid pump and drainback valve of this invention showing the shuttle position when the pump impeller is being driven.

As best shown in FIG. 2 and also in FIGS. 4 and 5, the cylindrical bores 38 and 40 are internally threaded at their outer ends to receive external threads provided on fluid connectors 70 and 72 respectively. The connectors 70 and 72 have suitable engaging means 74 and 76 formed thereon to ensure a fluid tight connection with tubes connected thereto.

Referring now to FIG. 5, when the shaft 34 of the gear 30 is driven, fluid is drawn through the connector 70, the inlet port 38 and inlet passage 22 to be driven by the rotating gears 30 and 32 to the outlet passage 24. The pressure of the fluid being driven through the outlet passage 24 will cause the shuttle 46 to compress the springs 48 to a open path through the outlet port 40. Thus, a fluid may be drawn through the inlet port 38 and the inlet passage 22, to the pump cavity 16 and discharged through the outlet passage 24 and the outlet port 40. When the gear 30 is no longer driven, fluid pressure from the outlet passage 24 will no longer be adequate to overcome the biasing force of the spring 48 which will then force the shuttle 46 into the outlet port 40. With the shuttle positioned in the outlet port 40, a flow path is provided between the outlet port 40 and the inlet port 38 through the shuttle valve cavity 46 as shown in FIG. 4.

The pressure required to move the shuttle against the force of the resilient means may be adjusted by adjusting the position of the threaded plug 52 in the threaded shuttle valve cavity 42. In which case the threaded plug 52 also serves as an adjusting means.

Figure 3:
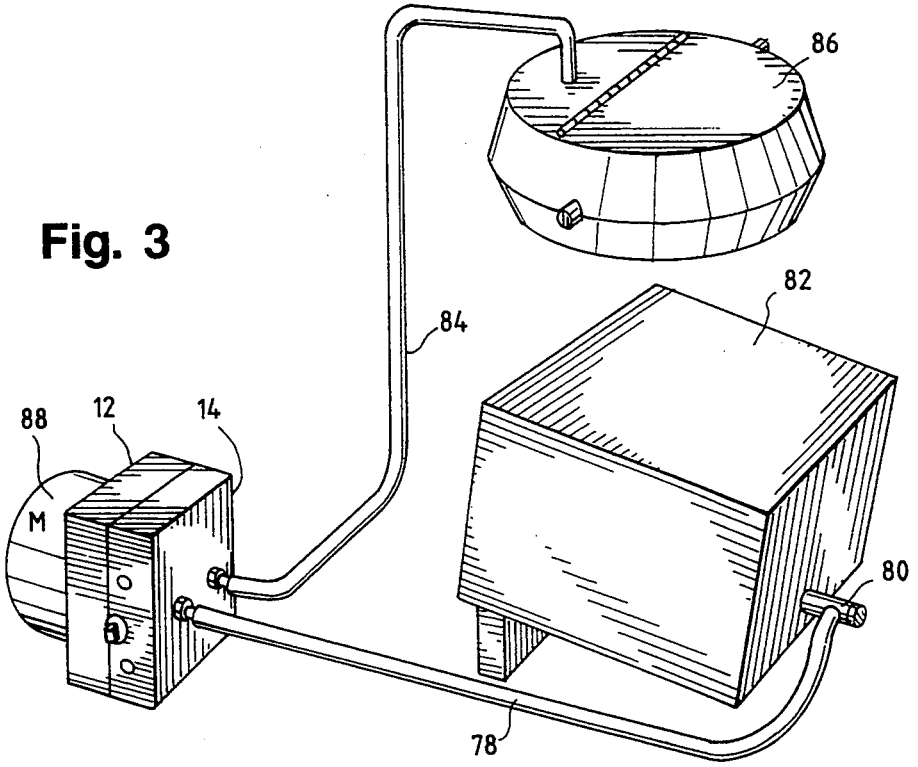
FIG. 3 is a pictorial view of the integral pump and drainback valve of this invention as utilized with a popcorn popping system.

Referring now to FIG. 3, an intended use of the integral liquid pump and drainback valve will be described. The inlet connector 70 of the integral liquid pump and drainback valve assembly 10 is connected by a tubing 78 to a discharge valve 80 provided on a storage or supply container 82. The outlet connector 72 of the assembly 10 is connected to a tubing 84 which terminates in a popping kettle 86. Thus, when a motor 88 driving shaft 34 is de-energized, such that fluid is no longer pumped from the storage container 82 through the tubing 78 and the tubing 84 to the popping kettle 86, the fluid in the discharge tubing 84 will drain back through the shuttle valve cavity 42 and the inlet tubing 78 to the storage container 82. When the elevation of the fluid in the discharge tubing 84 is equal to that of the upper surface of the fluid stored in the container 82, the flow through the shuttle valve cavity 42 and the tubing will cease. While the popping kettle 86 is shown to be positioned just slightly above the storage container 82 in FIG. 3, in a typical installation, they would be separated by a greater vertical distance, and thus, a much longer segment of the discharge tubing 84 would be drained of fluid through the shuttle valve cavity 42.

While not shown, the housing members 12 and 14 are secured to each other by fastening means such as bolts which extend through the holes 62, 64, 66 and 68, and nuts. To periodically clean the integral pump and drainback valve, it is only necessary to release the fastening means to separate the housing parts from each other such that the gears 30 and 32 may be removed from the first housing part. Similarly, the shuttle 46 and spring 48 may be removed from the shuttle cavity by removing the plug 52 from the shuttle cavity.

While in accordance with the U.S. Patent Statutes, a preferred embodiment of the invention has been shown and described, various changes may be made in the integral liquid pump and drainback valve of this invention without parting from the true spirit and scope of this invention. For instance, in another embodiment of this invention, the resilient biasing means, such as spring 48, urging the shuttle toward the outlet port may be omitted. In this embodiment, the housing is designed to be installed such that the side of the housing in which threaded plug 52 is received is the top of the housing. Installed in this way, the gravitational force on the shuttle 46 will cause it to assume the position shown in FIG. 4 when the pump is not running. When the pump is running, the shuttle 46 will be lifted by the pumped fluid pressure to the position shown in FIG. 5. Thus, the gravitational force on the shuttle serves the same purpose as the resilient biasing means.

The appended claims are intended to encompass all such changes and modifications which falls within the true spirit and scope of this invention.

I claim:

1. An integral liquid pump and drainback valve comprising, a housing, a pump impeller means, a pump impeller cavity formed in said housing for receiving said pump impeller means, an inlet passage formed in said housing in fluid flow communications with said pump impeller cavity, and outlet passage formed in said housing in fluid flow communications with said pump impeller cavity, an inlet port formed in said housing, an outlet port formed in said housing, a shuttle valve cavity formed in said housing, said shuttle valve cavity in fluid flow communications with both said inlet passage and said outlet passage, and with both said inlet port and said outlet port, a shuttle received within said shuttle valve cavity, a resilient biasing means received within said shuttle valve cavity, said resilient biasing means urging said shuttle toward said outlet port so as to essentially block fluid flow through said shuttle valve cavity between said outlet port and said outlet passage, means for driving said impeller means, said impeller means when driven drawing fluid from said inlet port through said shuttle valve cavity and said inlet passage and discharging it through said outlet passage to said shuttle valve cavity, the discharge of fluid through said outlet passage causing said shuttle to be moved against said biasing means to permit the discharge of fluid through said shuttle valve cavity to said outlet port, said shuttle being moved by said biasing means when said impeller means is no longer driven to essentially block fluid flow through said shuttle valve cavity between said outlet passage and said outlet port, and to provide fluid flow communications through said shuttle valve cavity between said outlet port and said inlet port to permit fluid to be returned through said outlet port and said shuttle valve cavity to said inlet port so as to equalize the fluid pressures at said inlet and outlet ports.

2. The integral liquid pump and drainback valve of claim 1, wherein said resilient biasing means is a coil spring.

3. The integral liquid pump and drainback valve of claim 2, including an adjusting means movably supported by said housing, wherein said coil spring has first and second ends, said first end engaging said shuttle, and said second end engaging the adjusting means which is moved with respect to said housing for adjusting the biasing force applied to said shuttle by said resilient biasing means.

4. The integral liquid pump and drainback valve of claim 3, wherein a portion of said shuttle cavity is provided with internal threads, and said adjusting means is provided with external threads which engage said internal threads, such that rotation of said adjusting means with respect to said housing adjusts the biasing force applied to said shuttle by said resilient biasing means.

5. The integral liquid pump and drainback valve of claim 1, wherein said pump impeller means is a pair of counter-rotating gears forming a gear pump.

6. The integral liquid pump and drainback valve of claim 5, wherein said housing is formed of first and second housing members, said pump impeller cavity and said inlet and said outlet passages are formed in said first housing member, and said inlet port, said outlet port, and said shuttle valve cavity are formed in said second housing member.

7. The integral liquid pump and drainback valve of claim 6, wherein a pair of holes are formed in said first housing member, and said pair of counter-rotating gears are provided with shafts which are supported for rotation in said pair of holes.

8. The integral liquid pump and drainback valve of claim 7, wherein one of said pair of holes is a blind hole and the other of said pair of holes extends through said first housing member and said shaft supported for rotation in the other of said pair of holes extends from said first housing member such that a rotational force may be applied to said shaft to drive said pump impeller means.

9. The integral liquid pump and drainback valve of claim 8, wherein a portion of the other of said pair of holes is enlarged to receive a seal which engages said shaft and said enlarged hole to prevent the escape of liquid from said pump impeller cavity along said shaft.

10. The integral liquid pump and drainback valve of claim 6, wherein said first and second housing members are provided with abutting faces, and a groove is formed in one of said faces spaced from and encircling said pump impeller cavity, an O-ring is received in said groove to provide a liquid tight seal between said first and second housing members.

11. The integral liquid pump and drainback valve of claim 6, wherein at least two apertures are provided in each of said first and second housing members, with each of said at least two apertures in said first housing member being aligned with one of said at least two apertures in said second housing member, at least two fastening means extending through said at least two apertures to secure said first and second housing members to each other.

12. The integral liquid pump and drainback valve of claim 6, wherein said shuttle valve cavity intersects said inlet port and said outlet port.

13. An integral liquid pump and drainback valve comprising, a housing, a pump impeller means, a pump impeller cavity formed in said housing for receiving said pump impeller means, an inlet passage formed in said housing in fluid flow communications with said pump impeller cavity, and outlet passage formed in said housing in fluid flow communications with said pump impeller cavity, an inlet port formed in said housing, an outlet port formed in said housing, a shuttle valve cavity formed in said housing, said shuttle valve cavity in fluid flow communications with both said inlet passage and said outlet passage, and with both said inlet port and said outlet port, a shuttle received within said shuttle valve cavity, said housing being positioned for use such that the gravitational force on said shuttle urges said shuttle toward said outlet port so as to essentially block fluid flow through said shuttle valve cavity between said outlet port and said outlet passage, means for driving said impeller means, said impeller means when driven drawing fluid from said inlet port through said shuttle valve cavity and said inlet passage and discharging it through said outlet passage to said shuttle valve cavity, the discharge of fluid through said outlet passage causing said shuttle to be moved against the gravitational force to permit the discharge of fluid through said shuttle valve cavity to said outlet port, said shuttle being moved by the gravitational force when said impeller means is no longer driven to essentially block fluid flow through said shuttle valve cavity between said outlet passage and said outlet port, and to provide fluid flow communications through said shuttle valve cavity between said outlet port and said inlet port to permit fluid to be returned through said outlet port and said shuttle valve cavity to said inlet port so as to equalize the fluid pressures at said inlet and outlet ports.

14. The integral liquid pump and drainback valve of claim 13, wherein said pump impeller means is a pair of counter-rotating gears forming a gear pump.

15. The integral liquid pump and drainback valve of claim 14, wherein said housing is formed of first and second housing members, said pump impeller cavity and said inlet and said outlet passages are formed in said first housing member, and said inlet port, said outlet port, and said shuttle valve cavity are formed in said second housing member.

16. The integral liquid pump and drainback valve of claim 15, wherein a pair of holes are formed in said first housing member, and said pair of counter-rotating gears are provided with shafts which are supported for rotation in said pair of holes.

17. The integral liquid pump and drainback valve of claim 16, wherein one of said pair of holes is a blind hole and the other of said pair of holes extends through said first housing member and said shaft supported for rotation in the other of said pair of holes extends from said first housing member such that a rotational force may be applied to said shaft to drive said pump impeller means.

18. The integral liquid pump and drainback valve of claim 15, wherein said first and second housing members are provided with abutting faces, and a groove is formed in one of said faces spaced from and encircling said pump impeller cavity, an O-ring is received in said groove to provide a liquid tight seal between said first and second housing members.

19. The integral liquid pump and drainback valve of claim 17, wherein a portion of the other of said pair of holes is enlarged to receive a seal which engages said shaft and said enlarged hole to prevent the escape of liquid from said pump impeller cavity along said shaft.

20. The integral liquid pump and drainback valve of claim 15, wherein at least two apertures are provided in each of said first and second housing members, with each of said at least two apertures in said first housing member being aligned with one of said at least two apertures in said second housing member, at least two fastening means extending through said at least two apertures to secure said first and second housing members to each other.

21. The integral liquid pump and drainback valve of claim 15, wherein said shuttle valve cavity intersects said inlet port and said outlet port.

22. An integral liquid pump and drainback valve comprising, a housing, a pump impeller means, a pump impeller cavity formed in said housing for receiving said pump impeller means, an inlet passage formed in said housing in fluid flow communications with said pump impeller cavity, and outlet passage formed in said housing in fluid flow communications with said pump impeller cavity, an inlet port formed in said housing, an outlet port formed in said housing, a shuttle valve cavity formed in said housing, said shuttle valve cavity in fluid flow communications with both said inlet passage and said outlet passage, and with both said inlet port and said outlet port, means for driving said impeller means, a shuttle received within said shuttle valve cavity, said shuttle blocking fluid flow through said shuttle valve cavity between said outlet passage and said outlet port when said pump impeller means is not driven, said impeller means when driven drawing fluid from said input port through said shuttle valve cavity and said inlet passage and discharging it through said outlet passage to said shuttle valve cavity, the discharge of fluid through said outlet passage to said shuttle valve cavity causing said shuttle to be moved to permit the discharge of fluid through said shuttle valve cavity to said outlet port, said shuttle again blocking fluid flow communication through said shuttle valve cavity between said outlet passage and said outlet port when said impeller means is no longer driven, and fluid flow communications being provided through said shuttle valve cavity between said outlet port and said inlet port to permit fluid to be returned through said outlet port and said shuttle valve cavity to said inlet port so as to equalize the fluid pressures at said inlet and outlet ports.

* * * * *